United States Patent [19]

Bar-Nefy et al.

[11] Patent Number: 4,690,030

[45] **Date of Patent: * Sep. 1, 1987**

[54] MINE FIELD CLEARING APPARATUS

[75] Inventors: Simcha Bar-Nefy, Omer; Michael Tiomkin, Beersheva, both of Israel

[73] Assignee: Israel Aircraft Industries Ltd., Ben Gurion Airport, Israel

[ * ] Notice: The portion of the term of this patent subsequent to Jan. 1, 2002 has been disclaimed.

[21] Appl. No.: 653,835

[22] Filed: Sep. 24, 1984

Related U.S. Application Data

[63] Continuation-in-part of Ser. No. 554,639, Nov. 23, 1983, Pat. No. 4,590,844.

[30] Foreign Application Priority Data

Sep. 25, 1983 [IL] Israel ..... 69802

[51] Int. Cl.[4] ..... F41F 3/02

[52] U.S. Cl. ..... 89/1.13; 171/141; 172/828

[58] Field of Search ..... 89/1.13; 171/141; 172/815, 828, 466

[56] References Cited

U.S. PATENT DOCUMENTS

| | | | |
|---|---|---|---|
| 1,423,887 | 7/1922 | Stewart | 414/443 X |
| 2,298,671 | 10/1942 | Bayes | 37/108 |
| 2,322,115 | 6/1943 | Cox et al. | 172/766 X |
| 2,388,015 | 10/1945 | Shoemaker | 414/443 |
| 2,460,322 | 2/1949 | Walker | 89/1.13 |
| 2,479,719 | 1/1948 | Boylan | 55/17 |
| 2,486,372 | 10/1949 | Rockwell | 89/1.13 |
| 2,489,349 | 11/1949 | White | 89/1.13 |
| 2,933,838 | 4/1960 | Rockwell | 37/144 |
| 3,513,916 | 5/1970 | Hyler | 172/4 |
| 4,279,138 | 7/1981 | Van Der Lely | 172/4 |
| 4,372,441 | 2/1983 | Krammer . | |
| 4,384,620 | 5/1983 | Uchida et al. | 172/815 |
| 4,491,053 | 1/1985 | Bar-Nefy et al. | 89/1.13 |
| 4,552,053 | 11/1985 | Bar-Nefy et al. | 89/1.13 |

FOREIGN PATENT DOCUMENTS

| | | |
|---|---|---|
| 807503 | 4/1969 | Canada . |
| 851543 | 9/1970 | Canada . |
| 985221 | 3/1976 | Canada . |
| 0071384 | 2/1983 | European Pat. Off. . |
| 2430709 | 6/1974 | Fed. Rep. of Germany . |
| 2632568 | 1/1978 | Fed. Rep. of Germany . |
| 2106454 | 4/1983 | United Kingdom . |
| 682611 | 1/1975 | U.S.S.R. . |

*Primary Examiner*—Peter A. Nelson

*Attorney, Agent, or Firm*—Finnegan, Henderson, Farabow, Garrett & Dunner

[57] ABSTRACT

Mine clearing apparatus for attachment to a vehicle and comprising a frame mountable onto a vehicle for selectable positioning in a raised or lowered orientation; apparatus mounted onto the frame for raising and shunting aside mines; and apparatus operable from inside the vehicle for automatically raising the plow from its lowered orientation to its raised orientation independently of vehicle movement. The frame may include angled side portions mountable onto the vehicle and having a profile complementary to that of the vehicle and the apparatus for raising and shunting aside mines includes a pair of angled arms having a profile complementary to that of the frame and the vehicle.

15 Claims, 7 Drawing Figures

MINE FIELD CLEARING APPARATUS

REFERENCE TO RELATED APPLICATIONS

This application is a continuation in part of applicants' co-pending U.S. application Ser. No. 554,639 now U.S. Pat. No. 4,590,844.

FIELD OF THE INVENTION

The present invention relates to apparatus for clearing mines, and more particularly to mine clearing apparatus mountable on an armoured vehicle such as a tank.

BACKGROUND OF THE INVENTION

There is described and claimed in applicant's U.S. Pat. No. 4,467,694 apparatus for clearing mines which overcomes the difficulties and disadvantages of conventional prior art mine clearing techniques and apparatus and which comprises a frame mountable onto a vehicle for selectable positioning in a raised or lowered orientation; apparatus for raising and shunting aside mines mounted onto the frame; and apparatus for selectably retaining the frame in a raised orientation and comprising control apparatus operable from inside the vehicle for releasing the frame from the raised orientation and allowing it to assume the lowered orientation.

There is also described and claimed in applicant's U.S. Pat. No. 4,491,053 apparatus for clearing mines comprising a frame mountable onto a vehicle for selectable positioning in a raised or lowered orientation; plow apparatus for raising and shunting aside mines mounted onto the frame; and apparatus for automatically raising the plow from its lowered orientation to its raised orientation in response to backwards motion of the vehicle and including mounting apparatus rotatably mounted onto the vehicle, spring supporting apparatus mounted onto the mounting apparatus and attached to the plow apparatus; and tooth apparatus fixed onto the mounting apparatus and arranged for selectable engagement with the vehicle tread, the spring supporting apparatus being operative when the plow is in its lowered orientation to urge the tooth apparatus into driven engagement with the vehicle tread whereby during backwards movement of the vehicle, the mounting apparatus rotates in a first direction, thereby extending the length of the spring supporting apparatus, and increasing the spring force thereof until a spring force is reached at a first position of the mounting apparatus sufficient to raise the plow to its raised orientation. Continued rotation of the mounting apparatus raises the plow until it engages a retaining hook, and is held stationary.

In addition, there is described and claimed in applicant's U.S. Pat. No. 4,552,053 mine clearing apparatus for attachment to a vehicle and comprising a frame mountable onto a vehicle for selectable positioning in a raised or lowered orientation; apparatus mounted onto the frame for raising and shunting aside mines including first and second plow sections disposed one above another in hinged engagement, the second plow section being associated with a plurality of plow teeth which, in operation, extend below the ground surface, the first and second plow sections being operative to lie in generally the same plane during operation and in folded engagement when the frame is in its raised orientation, the raising and shunting aside apparatus being mounted on the frame in front of the ground engaging members on each side of the vehicle and being angularly oriented to have a forward edge adjacent the interior of the vehicle and a rearward edge adjacent the side edge of the vehicle, each of the forward edges being provided with a chain attached to the first and second plow sections such as to be tensioned when the first and second plow sections are in their operating orientations to thereby define a barrier against mines passing from adjacent the forward edge to the relatively unprotected area at the interior of the vehicle.

SUMMARY OF THE INVENTION

The present invention seeks to provide various improvements to the apparatus for clearing mines described in the aforementioned U.S. patents.

There is thus provided in accordance with one preferred embodiment of the present invention mine clearing apparatus for attachment to a vehicle and comprising a frame mountable onto a vehicle for selectable positioning in a raised or lowered orientation; apparatus mounted onto the frame for raising and shunting aside mines; and apparatus operable from inside the vehicle for automatically raising the plow from its lowered orientation to its raised orientation independently of vehicle movement.

Further in accordance with the present invention, the apparatus for raising and shunting aside mines includes a plow section, the plow section defining a plurality of plow teeth which, in operation, extend below the ground surface, and first and second plow sections, disposed one above the other in hinged engagement and operative to lie in the same plane during operation and in folded engagement when the frame is in its raised orientation, so as not to interfere with normal tank operation. In addition, a segment of the plow section may be removable.

Still further in accordance with an embodiment of the present invention, each of the plurality of plow teeth defines an angled tip adapted to break through the crust of the earth to facilitate the plowing thereof.

Still further in accordance with a preferred embodiment, the apparatus for automatically raising includes an motor having a harmonic drive.

In accordance with an alternate preferred embodiment of the invention, the frame includes angled side portions mountable onto the vehicle and having a profile complementary to that of the vehicle and the apparatus for raising and shunting aside mines includes a pair of angled arms having a profile complementary to that of the frame and the vehicle.

Additionally in accordance with an embodiment of the invention, there is provided apparatus for clearing mines comprising a frame mountable onto a vehicle for selectable positioning in a raised or lowered orientation; apparatus mounted onto the frame for raising and shunting aside mines; and apparatus for selectably retaining the frame in a raised orientation and including raising apparatus operable from inside the vehicle for automatically raising the plow from its lowered orientation to its raised orientation; the selectably retaining apparatus including a hook member pivotably mounted onto the vehicle at a central location on the hook member and having a roller engaging slot at a first end thereof, an intermediate link pivotably coupled to the hook member at a second end thereof opposite to the first end with respect to the central location, an operating lever of elongate configuration, pivotably mounted at a first intermediate location therealong onto the vehicle and pivotably attached to the intermediate link at a second intermediate location along the operating lever, solenoid operated displacement apparatus disposed in contacting relationship with a first end of the operating lever adjacent the first intermediate location therealong, and a spring connection between the intermediate location adjacent its attachment to the operating lever and a fixed location with respect to the vehicle, the selectably retaining apparatus being operative to move from a roller retaining orientation to a roller releasing orientation as the second intermediate location crosses the line connecting the pivot mounting of the first intermediate location of the operating lever and the pivot mounting at the second end of the hook member.

Still further in accordance with an embodiment of the invention, the plow raising apparatus includes motor apparatus in driving engagement with a pulley, and belt apparatus affixed to the raising and shunting means and adapted for winding engagement about the pulley.

BRIEF DESCRIPTION OF THE DRAWINGS

The apparatus of the present invention will be further understood and appreciated from the following detailed description taken in conjunction with the drawings in which.

DETAILED DESCRIPTION OF THE INVENTION

Figure 1:
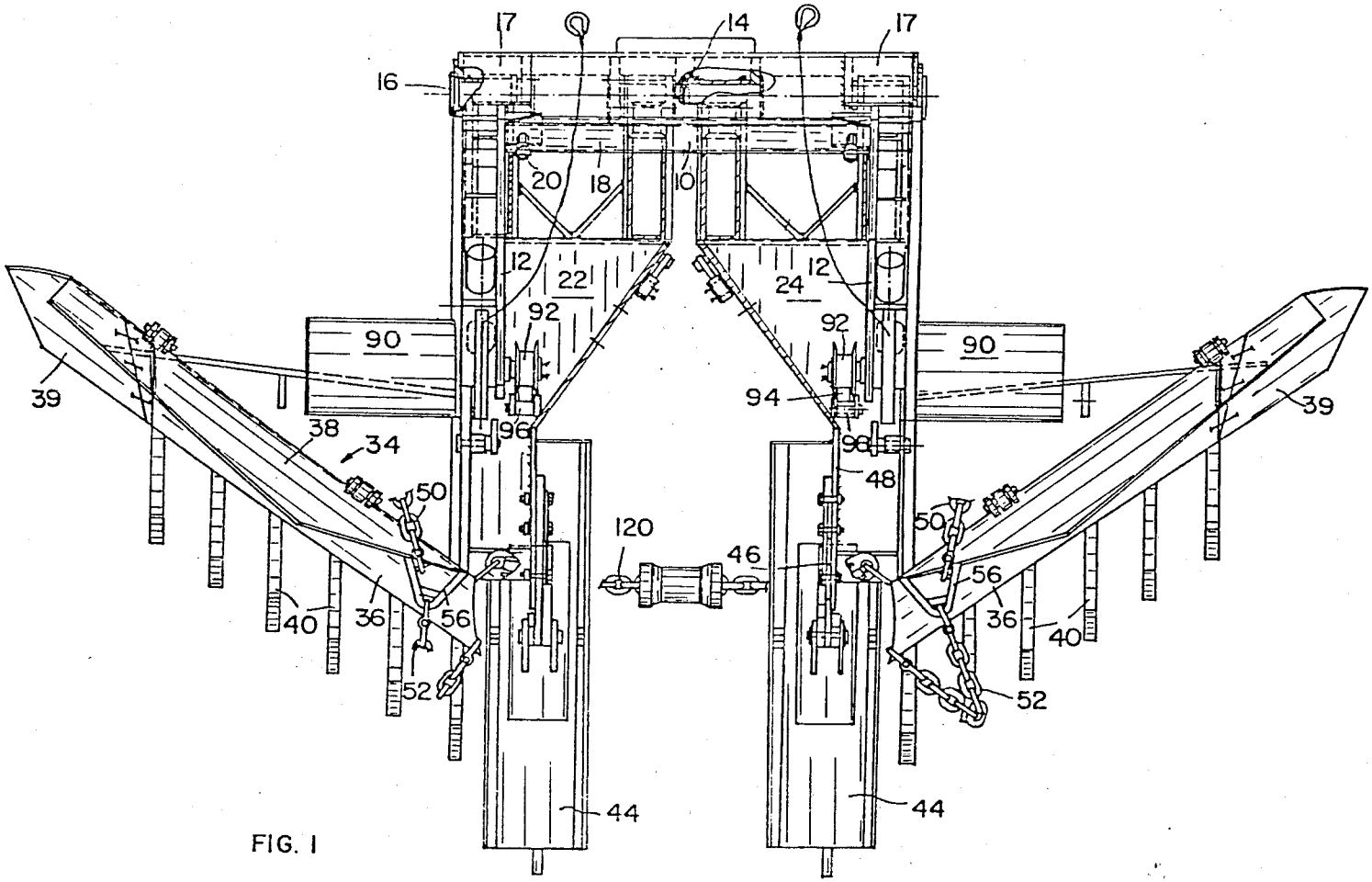
FIG. 1 is a top view illustration of mine clearing apparatus constructed and operative in accordance with an embodiment of the present invention.

Reference is now made to FIGS. 1–3B which illustrate mine clearing apparatus constructed and operative in accordance with an embodiment of the present invention. The present description is presented with particular reference to mine clearing apparatus which is mountable onto two particular types of tank, the Centurion and the M-1. It is appreciated that this is entirely for the purpose of illustration and that the invention is applicable to other types of tanks and possibly other vehicles as well.

As seen in the illustrations, the mine clearing apparatus comprises a frame 10 including a pair of identical side portions 12 which support at their rear ends an axle 16. Frame 10 is rigidly mounted onto an armoured vehicle, such as a Centurion tank in the illustrated embodiment, by engagement of pins located at side portions 12 with towline lugs 13 fixed onto the tank. Rigidity of mounting is provided by tight engagement of force mounting plates 17, fixedly mounted onto side portions 12, with the underside hull of the tank. In addition, upper cross bar 18 is retained in engagement with the upper hull of the tank as by screws 20.

First and second Y-shaped arms 22 and 24 are independently rotatably mounted within tow hitches 14 of frame 10 onto axle 16 and extend forwardly thereof in generally parallel planes. It is a particular feature of the present invention that due to their shape and internal mounting, arms 22 and 24 are particularly strong, yet they will not cause axle 16 to bend. Thus, the device of the present invention has two advantages over prior art mine clearing apparatus: that separate reinforcing elements are not required to support the arms; and that the arms will not cause axle 16 to bend, as often occurred when the arms were mounted outside of side portions 12.

Rigidly mounted onto each of arms 22 and 24 is a mine plowing assembly 34. Mine plowing assembly 34 comprises main plow portion 36, of generally elongate configuration and concave cross section.

The general configuration of main plow portion 36 may be similar to that of an ordinary vehicle powered snow plow. Disposed above main plow portion 36 and hinged thereonto is an auxiliary plow portion 38. Auxiliary plow portion 38 has two positions, a lowered position in which it extends forwardly of the surface of main plow portion 36 and a raised position in which it defines an upper continuation of the surface of the main plow portion 36. This hinged construction is to obviate the problem of interference with a driver's field of vision or with the range of operation of the armament on the tank. Towards this end, the hinged auxiliary plow portion 38 may be lowered when the plowing assembly 34 is in its raised orientation.

It will be appreciated that in order to plow the mines as far from the tank as possible, it is desired to utilize a main plow section which extends beyond the treads of the tank. However, such elongated plow sections make it difficult to maneuver the mine clearing apparatus when it is travelling to and from the fields to be cleared. There is thus provided, in accordance with a preferred embodiment of the present invention, a truncated main plow section 36 and auxiliary plow section 38 and a removable outermost plow section 39 which can be manually bolted onto the end of the truncated plow section upon arrival to the field to be cleared.

Disposed below main plow portion 36 there are provided a plurality of vertically disposed planar plow teeth 40 which, during operation, are disposed below the ground surface. The horizontal spacing between adjacent vertical teeth is selected to be such that anti-vehicle mines will, of necessity, be engaged thereby. The teeth are provided with an inclined forward surface, so as to raise mines located under the ground surface into engagement with main plow portion 36, so that they may be plowed aside.

Each of plow teeth 40 is provided with an angled, pointed tip 41. Due to the small area of the tip 41, a great deal of pressure is concentrated thereon when the plow section is lowered to the ground. This forces tips 41 into the earth, even through hard, crusty earth, and initiates the plowing action. It is a particular feature of the present invention that unplowed areas due to the sliding of teeth 40 along crusty earth are thus avoided.

A desired depth of operation for teeth 40 is determined by means of a gliding surface assembly 42 which is articulatedly mounted onto each of arms 22 and 24. The gliding surface assembly 42 comprises a sled 44 which is arranged to slide on the ground surface and is formed at its front with a vertical blade 47 for deflecting mines to the side therof. Sled 44 is rotatably mounted onto a cam slot of a mounting plate 46. Mounting plate 46 is mounted in turn onto a mounting element 48. It is appreciated that sled 44 is permitted to undergo a somewhat complex articulated motion in a single plane within limits defined by the respective cam paths. This mounting arrangement permits selectable adjustment of the penetration depth of the plowing assembly 34 and also permits the sled 44 to be folded when the plowing assembly is in its raised orientation to eliminate interference with operation of the tank.

A chain 50 extends from each auxiliary plow portion 38 to a location on the tank hull or onto frame 10. The length of the chain 50 is selected such that it is slack when the plowing assembly is in its raised orientation but becomes tight when the plowing assembly is lowered, thus pulling on auxiliary plow portion 38 and orienting it towards a generally vertical orientation. The full raised orientation of the auxiliary plow portion 38 is reached only when soil being plowed is forced thereagainst.

An additional chain 52 is disposed at the inner facing edge 53 of each plowing assembly and extends from the lower inner corner of each plow portion 36 to a location 54 defined by the extreme forward facing portion of a bracket 56 disposed on auxiliary plow portion 38. When the plowing assembly is in a raised orientation and plow portions 36 and 38 are in relative folded orientation, the chain is slack and does not interfere with folding of the plow portions or with operation of the vehicle. When the plowing assembly is in its lowered operating orientation as seen in FIG. 2, chain 52 is taut and defines a barrier which prevents mines excavated by the plowing assembly from rolling or being directed inwardly of the inner facing edge of the plowing assembly into the region which is unprotected by the plowing assembly.

Figure 2:
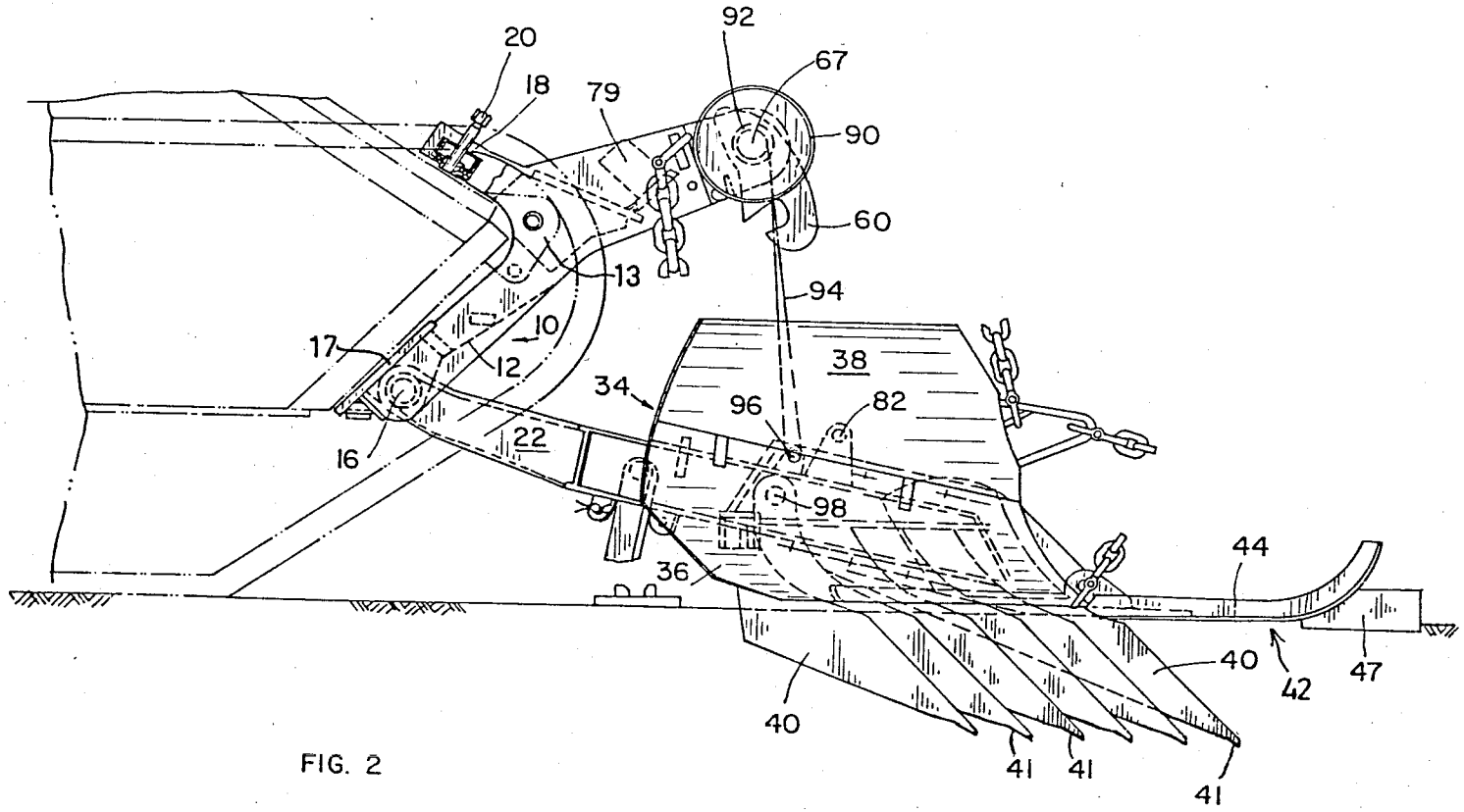
FIG. 2 is a side view illustration of the apparatus of FIG. 1 in a lowered orientation.
Figure 3A:
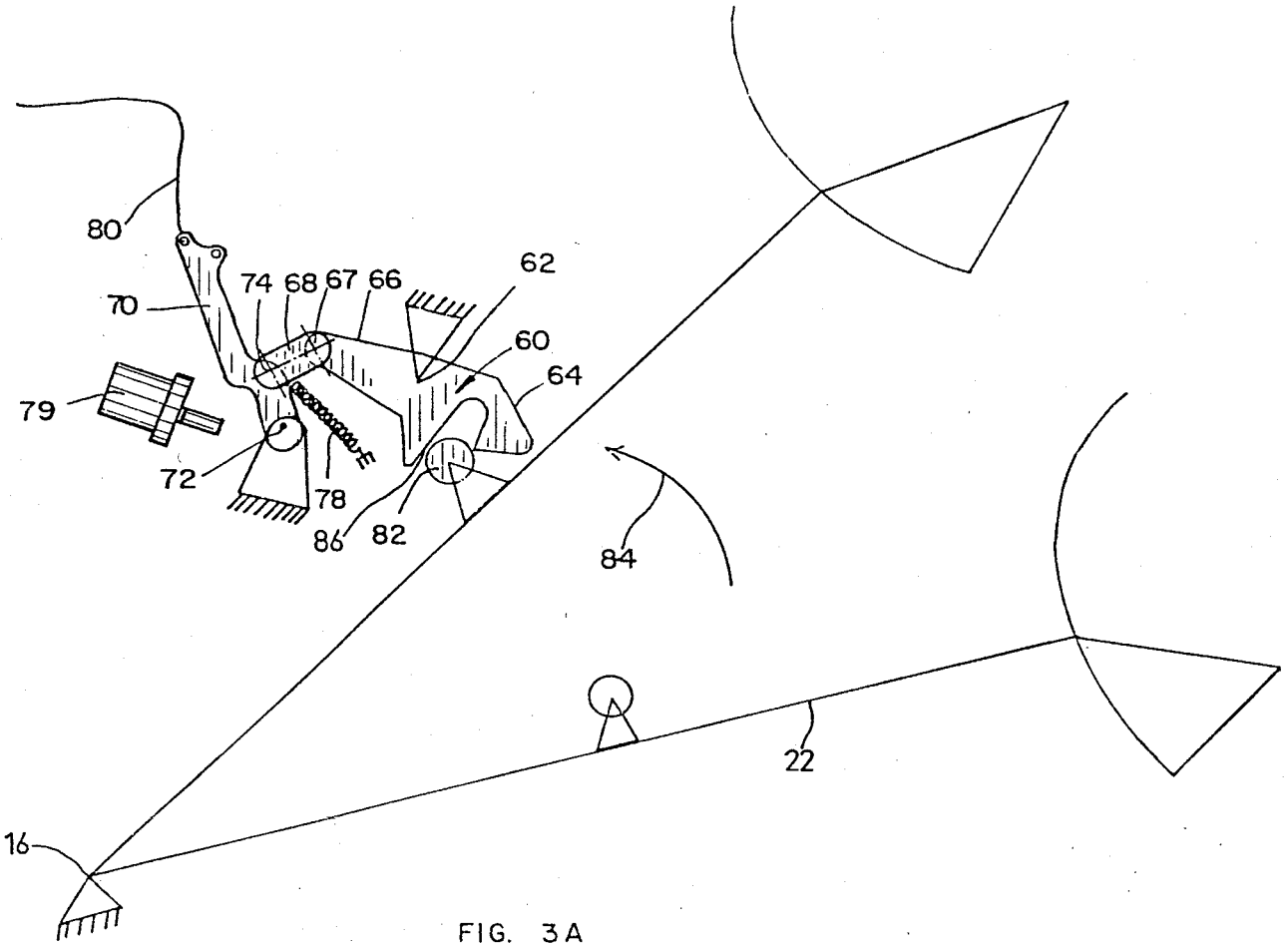
FIGS. 3A and 3B are respective views of a locking mechanism forming part of the apparatus of FIGS. 1 and 2 in respective unlocked and locked orientations.
Figure 3B:
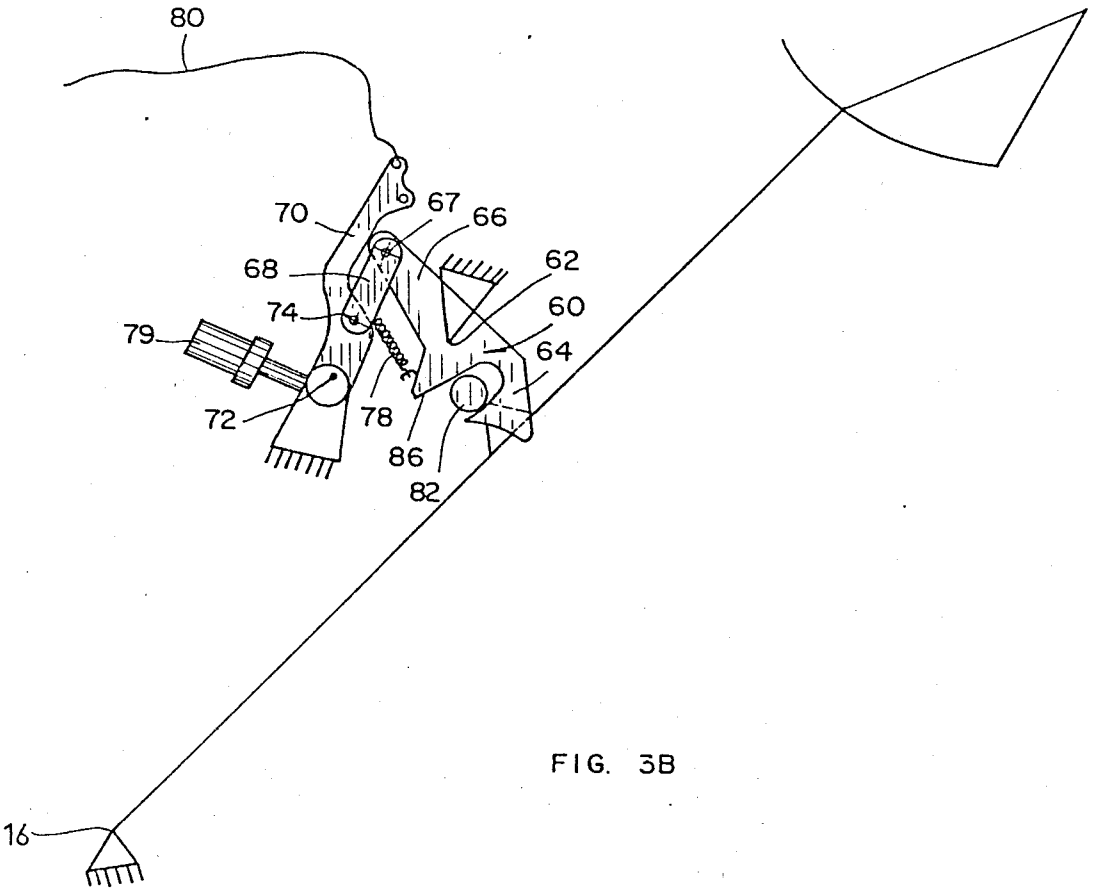

Reference is now made to FIGS. 3A and 3B which, together with FIGS. 1 and 2, illustrate apparatus for retaining the arms in their raised orientation and for selectable release thereof. A hook member 60 is pivotably mounted about an axis 62 onto each side portion 12 and comprises a socket portion 64 defining a roller retaining slot located at one end thereof and a lever portion 66 at another end thereof and having pivotably mounted thereon, at a pivot location 67, an intermediate member 68. A selectable release lever 70 is pivotably mounted onto each side portion 12 about an axis 72 and is pivotably mounted onto intermediate member 68 at a pivot location 74.

A spring 78 joins intermediate member 68 to a fixed location on each side portion 12. Spring 78 is affixed to intermediate member 68 adjacent pivot location 74 such that the spring tends to urge the lever 70 to remain in whichever position it is at the time. It is noted that spring 78 is an over-center type of arrangement which provides its indicated dual function.

An electrically activated displacement apparatus controlled from within the tank, such as a solenoid operated device 79, is provided such that displacement of a portion of lever 70 is operative to provide counter-clockwise movement of lever 70 about its pivot axis 72 (as seen in FIGS. 3A and 3B). A cable connection 80 may additionally be provided to the exterior of the vehicle such that pulling on the cable is also operative to provide counter-clockwise movement of lever 70. This provides a manual means of releasing lever 70 in the event of a malfunction of the electrical displacement apparatus. It is appreciated that the solenoid operated device may be replaced by any other suitable displacement means.

The operation of the apparatus described hereinabove will be understood from a consideration of FIGS. 3A and 3B. FIG. 3A shows a retainer roller 82 which is fixedly mounted onto each of arms 22 and 24 about to engage socket portion 64 and moving in an arc illustrated by an arrow 84. Engagement of roller 82 with a surface 86 of the socket portion forces the hook member to pivot in a clockwise direction about its pivot axis (in the sense of FIGS. 3A and 3B).

The clockwise movement of the hook member 60 causes lever portion 66 to rotate, also in a clockwise sense, and to raise intermediate member 68 causing reorientation of the intermediate member 68 and thus of lever 70 such that pivot location 74 crosses the imaginary line joining pivot locations 67 and 72. This over-center orientation is illustrated in FIG. 3B and provides a stable locking orientation of the retaining apparatus. Hook member 60 is thus prevented from counterclockwise rotation into an open orientation. Roller 82 is thus securely engaged by hook member 60 and arms 22 and 24 are maintained in their respective raised orientation, provided that lever 70 remains in the locked position (FIG. 3B).

When it is desired to lower arms 22 and 24 to their respective lowered, ground engaging orientations, it is sufficient to activate the electrical displacement means, here the solenoid device 79, from the safety of the driver's compartment. Displacement of the proper portion of lever 70 causes the lever to pivot in a counterclockwise direction and to draw pivot location 74 back across the imaginary line joining pivot locations 67 and 72. Once the pivot location 74 crosses this line, counterclockwise motion of hook member 60 is permitted in response to the force exerted by the weight of the plowing apparatus applied to roller 82. It is a particular feature of the illustrated construction that only a very small amount of movement of lever 70 is required for release of the plowing apparatus into its lowered orientation.

Hook member 60 is then free to rotate in a counterclockwise direction about its pivot location such that roller pin 82 is released, thus allowing arm 22 or 24, as the case may be, and the associated mine plowing assembly 34 to fall by gravity into their respective lowered orientations in engagement with the ground.

Reference is now made once again to FIGS. 1 and 2 which also illustrate apparatus for automatically lifing the mine plowing assembly. There is provided a motor 90 mounted upon each of side sections 12 which is activated from within the driver's compartment. Each motor 90 is mounted in driving relationship with a pulley 92 which is mounted on the respective side section 12. Belt means 94, preferably a nylon belt able to withstand a heavy load, is attached to pulley 92 in such a way as to be wound around pulley 92 when the pulley rotates. Belt means 94 is affixed at its other end to a belt retainer 96 on arm 22 or 24 as the case may be. In a particularly effective embodiment of the present invention, a nylon belt able to withstand a load of six and a half tons is looped through belt retainer 96 affixed to arm 22 or 24 and both ends of the belt are affixed to one another and fixedly attached to pulley 92. Alternatively, any other suitable belt material, a chain or a cable may be utilized.

According to a preferred embodiment of the present invention, the motor 90 incorporates an harmonic drive mechanism which operates as a reducer of rpm. It is a characteristic of such a motor that has no self-locking property. Thus, raising of the mine plowing assembly is accomplished by rotation of the motor, but lowering of the assembly is accomplished by the force of gravity and the weight of the assembly alone, without the need for operation of the motor. An example of such a motor is model C-15221 incorporating an harmonic drive model HDUC 65-260-2A, which comprises one rigid and one flexible toothed wheel coupled to a generator and mounted within a body member, provided by H.K. Porter Company, Inc., Electrical Division, of Warren, Ohio, U.S.A. It will be appreciated that any other electrically operated automatic lifting means may alternatively be employed, such as a hydraulic piston apparatus coupled to arm 22 or 24.

When it is desired to raise plow section 34 from its ground engaging orientation into the raised orientation, motor 90 is activated which causes pulley 92 to rotate. This, in turn, causes belt 94 to wind around pulley 92, thus shortening the distance between pulley 92 and arm 22 or 24 and raising the arm. Motor 90 continues to cause pulley 92 to rotate until roller 82 enters into locking engagement in hook member 60, as described above with reference to FIGS. 3A and 3B. In a preferred embodiment, a microswitch or other sensor is mounted in side section 12 such that it comes into touching engagement with lever 70 when lever 70 is in the fully locked position of FIG. 3B. The microswitch is adapted to deactivate motor 90 when the fully locked, raised orientaion is reached, thus causing pulley 92 to stop rotating.

In the event of an electrical malfunction, it is also possible to manually raise plow section 34 by means of an emergency chain which may be affixed temporarily at one end thereof to chain mount 98 on arm 22 or 24 and at the other end thereof to the treads of the tank such that backwards motion of the tank pulls the chain and raises the plow section into the locked, raised orientation.

It is noted that the plowing assembly engages the ground surface in the vicinity of the treads and outwardly thereof. In order to protect the intermediate portion of the tank from mine damage, a weighted chain 120 is mounted between the two plowing assemblies to engage and detonate any mines that are encountered at a safe distance from the tank.

It is appreciated that it is often desired that a narrower tank, such as an M-113, should be able to travel in the path cleared by the mine clearing apparatus of the present invention. Should this be the case, an additional interior tooth may be added to plow section 36 such that the path plowed will be slightly wider than the treads of the tank carrying the plow. It will be appreciated, however, that this will slow the rate of clearing of the mine clearing apparatus due to the extra power required to plow to the side the additional amount of earth.

Figure 4:
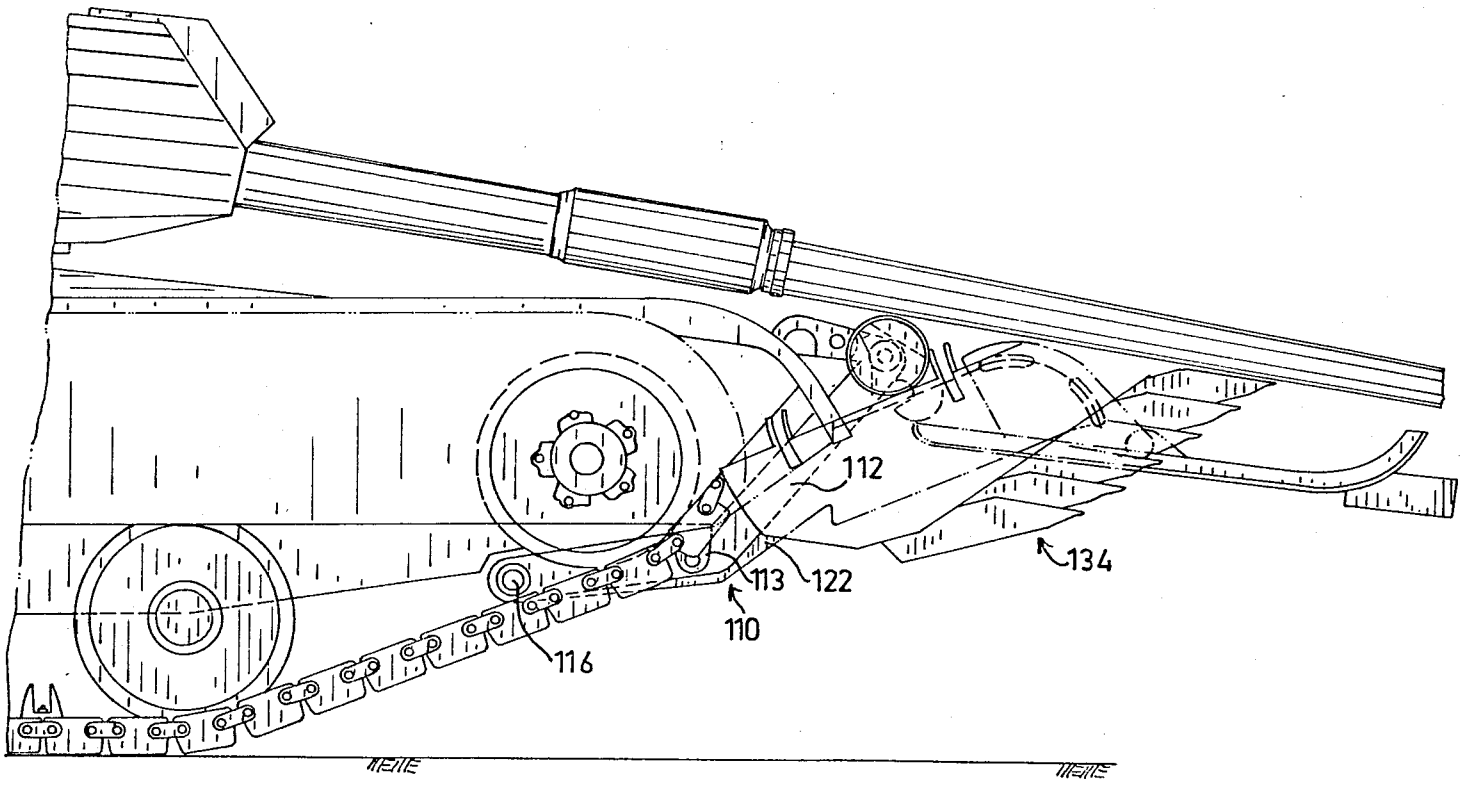
FIG. 4 is a side view illustration of a mine clearing apparatus constructed and operative in accordance with an alternate embodiment of the present invention, with the plow portion in a raised orientation.
Figure 5:
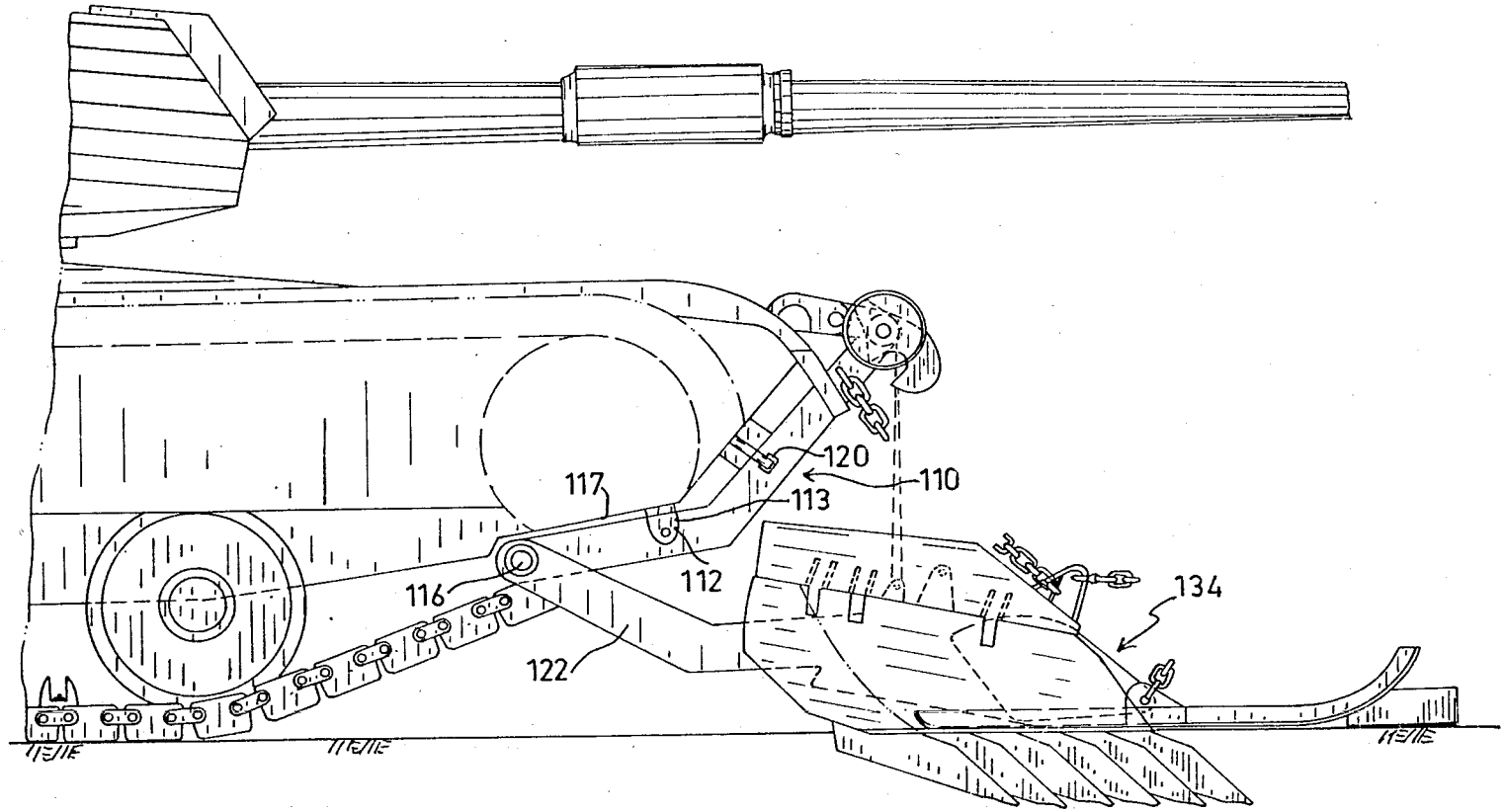
FIG. 5 is an illustration of the mine clearing apparatus of FIG. 4 with the plow portion in a lowered orientation.
Figure 6:
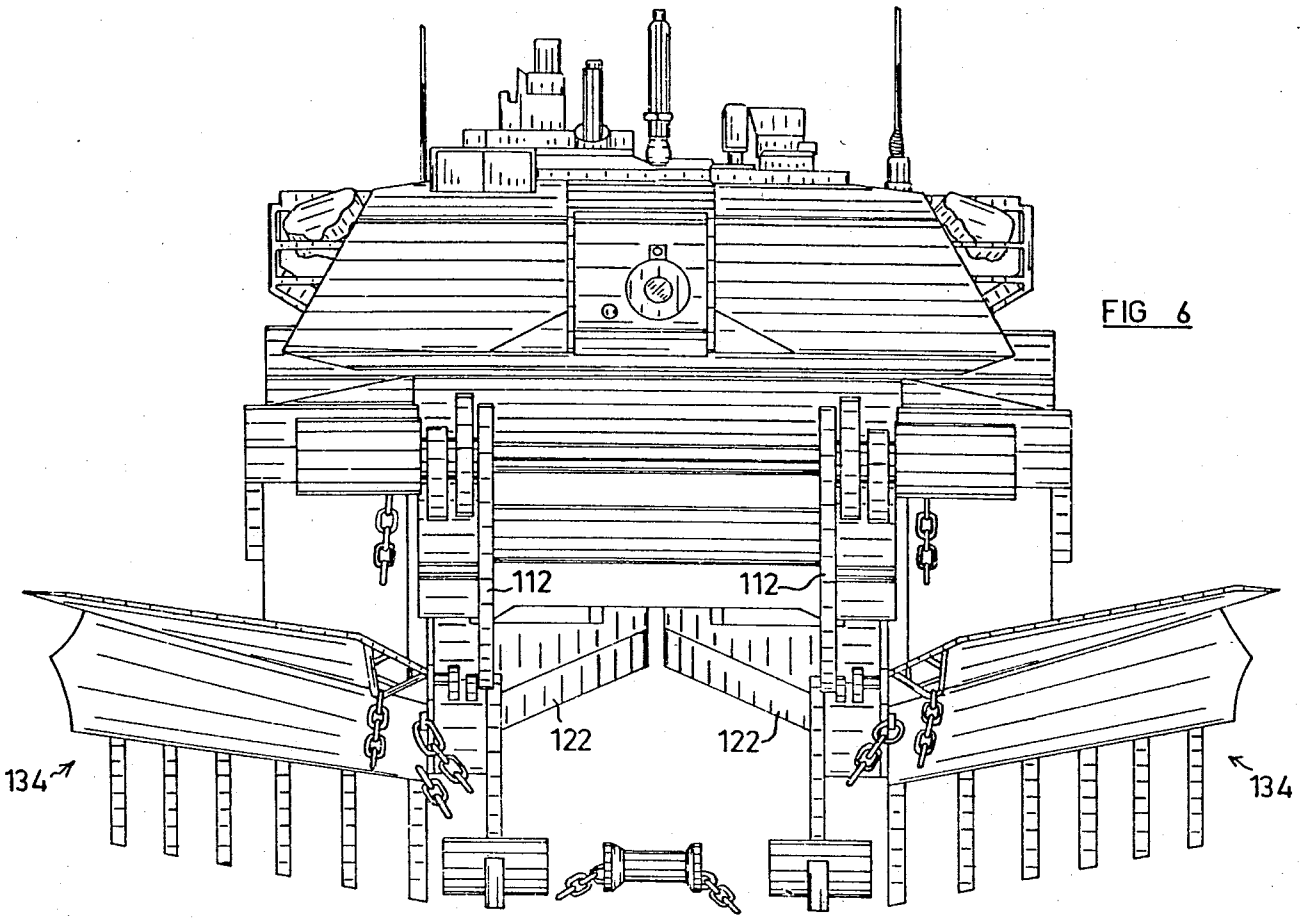
FIG. 6 is a top view illustration of the mine clearing apparatus of FIGS. 4 and 5.

Turning now to FIGS. 4 and 5, there is shown mine clearing apparatus constructed and operative in accordance with an alternate embodiment of the present invention. It will be appreciated by those skilled in the art that there are two important considerations for the mounting of mine plow apparatus onto a tank. First, the plow apparatus may not be mounted in such a position that it will reduce the ground clearance of the tank. Second, the approach angle (the angle defined by the ground and the treads rising along the lower front portion of the hull) should be maximized (or at least not severely reduced) to permit forward progress of the tank. At the same time, the mine plow apparatus must be mounted in such a way as to permit the widest range of movement of the barrel of the cannon, particularly in the earthward direction.

As can be seen from FIGS. 4 and 5, the hull of the M-1 has a different profile from that of the Centurion, and its towline lugs are affixed to the tank in a different location on the hull, i.e., further along the underside of the hull toward the rear of the tank. Were the mine clearing apparatus illustrated in FIGS. 1 and 2 mounted on an M-1 tank, the frame would not engage the hull of the tank as desired and the plow portion would tend to ride relatively close to the ground even in its raised orientation, drastically reducing the approach angle of the tank.

Accordingly, the mine clearing apparatus of FIGS. 4 and 5 comprises a frame 110 including a pair of identical angled side portions 112 which support at their rear ends an axle 116. Frame 110 is rigidly mounted onto the armoured vehicle, such as the illustrated M-1 tank, by engagement of pins located at the lower portion of the side portions 112 with towline lugs 113 fixed onto the tank. Rigidity of mounting is provided by tight engagement of the underside of the tank by mounting plates 117, fixedly mounted onto side portions 12. Mounting plates 117 are urged against the hull, for example, by screws 120. As can be seen from the illustrations, side portions 112 of frame 110 are angled so as to complement the shape of the tank profile, thus making possible tight engagement of the frame with the underside of the hull. First and second angled arms 122 are independently rotatably mounted within hitches of frame 110 onto axis 116 and extend forwardly thereof in generally parallel planes. As described above with reference to FIGS. 1 and 2, arms 122 are preferably Y-shaped for strength and to prevent bending of axle 116. It can be seen that arms 122 are also angled so as to partially complement the hull of the tank and the frame 110 in order to permit the plow portion to ride as close to the hull as possible while in the raised orientation.

Rigidly mounted onto each of arms 122 is a mine plowing assembly 134. Mine plowing assembly 134 is identical in all respects to the mine plowing assembly 34 of FIGS. 1 and 2 and may be raised and lowered in the same fashion.

It is a particular feature of this embodiment of the present invention that, due to the hull configuration of the tank and the complementary angling of the frame and arms, mine plow apparatus can be mounted on the tank without reducing the ground clearance of the tank and yet a particularly large approach angle is maintained for ease of travel. At the same time, the apparatus rides low enough not to interfere with the range of operation of the armament on the tank or the driver's field of vision.

It will be appreciated by those skilled in the art that the invention is not limited to what has been particularly shown and described hereinabove. Rather, the scope of the invention is limited only by the claims which follow.

We claim:

1. Mine clearing apparatus for attachment to a vehicle and comprising:

a frame mountable onto a vehicle for selectable positioning in a raised or lowered orientation;

means, mounted onto said frame, for raising and shunting aside mines to a location removed from the path of said vehicle;

means for selectably retaining said frame in a raised orientation; and electrically operated means operable from inside the vehicle for automatically raising said frame and said raising and shunting means from a lowered orientation to a raised orientation independently of vehicle motion, wherein said means for automatically raising comprises motor means as well as lifting means, the lifting means being affixed to said frame and being in driven engagement with said motor means.

2. Mine clearing apparatus in accordance with claim 1 and wherein said motor means comprises a motor incorporating an harmonic drive mechanism.

3. Mine clearing apparatus in accordance with claim 1 and wherein said means for raising and shunting aside mines comprises:

a plurality of plow teeth which, in operation, extend below the ground surface; and first and second plow sections, disposed one above the other in hinged engagement and operative to lie in the same plane during operation and in folded engagement when the frame is in its raised orientation, so as not to interfere with normal vehicle operation.

4. Apparatus according to claim 3 and wherein a portion of at least one of said first and second plow sections is removable.

5. Apparatus according to claim 1 and wherein said raising and shunting means comprises:

a gliding surface which supports said frame in its lowered orientation; and a front mine deflector plate arranged in front of said gliding surface for deflecting mines in the path thereof.

6. Apparatus according to claim 3 and wherein at least one of said plurality of plow teeth defines an angled tip adapted to break through the crust of the earth to initiate plowing thereof.

7. Apparatus according to claim 6 and wherein each of said plurality of plow teeth defines an angled tip adapted to break through the crust of the earth to initiate plowing thereof.

8. Apparatus according to claim 1 and wherein said frame comprises angled side portions mountable onto the vehicle and defining a profile complementary to that of the vehicle; and said means for raising and shunting aside mines comprises a pair of angled arms defining a profile complementary to that of the frame and the vehicle.

9. Apparatus for clearing mines comprising:

a frame mountable onto a vehicle for selectable positioning in a raised or lowered orientation;

means, mounted onto said frame, for raising and shunting aside mines to a location removed from the path of said vehicle, and a retaining roller mounted onto said frame;

electrically operated means operable from inside said vehicle for automatically raising said frame and said raising and shunting means from a lowered orientation to a raised orientation independently of vehicle motion, wherein said means for automatically raising comprises motor means as well as lifting means, the lifting means being affixed to said frame and being in driven engagement with said motor means; and means for selectably retaining said frame in a raised orientation comprising:

a hook member pivotably mounted onto said vehicle and defining a roller engaging slot in a first end thereof for engaging said retaining roller on the frame;

an operating lever of elongate configuration, pivotably mounted onto the vehicle and coupled to said hook member; and displacement means disposed in contacting relationship with said operating lever;

said selectably retaining means being operative to move from a roller retaining orientation to a roller releasing orientation in response to activation of said displacement means.

10. Apparatus for clearing mines according to claim 9 and wherein said displacement means comprise electrically operated displacement means.

11. Apparatus for clearing mines according to claim 9 and wherein said means for selectably retaining said frame in a raised orientation comprises:

a hook member pivotably mounted onto said vehicle at a central location on said hook member and having a roller engaging slot in a first end thereof;

an intermediate member pivotably coupled to said hook member at a second end thereof opposite to the first end with respect to the central location;

an operating lever of elongate configuration, pivotably mounted at a first intermediate location therealong onto the vehicle and pivotably attached to said intermediate member at a second intermediate location along the operating lever;

electrically operated displacement means disposed in contacting relationship with a first end of the operating lever adjacent said first intermediate location therealong; and a spring connection between the intermediate location adjacent its attachment to the operating lever and a fixed location with respect to said vehicle;

said selectably retaining apparatus being operative to move from a roller retaining orientation to a roller releasing orientation as the second intermediate location crosses the line connecting the pivot mounting of the first intermediate location of the operating lever and the pivot mounting at the second end of the hook member.

12. Mine clearing apparatus in accordance with claim 9 and wherein said motor means comprises a motor incorporating an harmonic drive mechanism.

13. Apparatus according to claim 9 and wherein said frame comprises angled side portions mountable onto the vehicle and defining a profile complementary to that of the vehicle; and said means for raising and shunting aside mines further comprises a pair of angled arms defining a profile complementary to that of the frame and the vehicle.

14. Apparatus in accordance with claim 1 and wherein said lifting means comprises:

pulley means mounted in driven engagement with said motor means; and belt means affixed to said raising and shunting means and adapted for winding engagement about said pulley means.

15. Apparatus in accordance with claim 9 and wherein said lifting means comprises:

pulley means mounted in driven engagement with said motor means; and belt means affixed to said raising and shunting means and adapted for winding engagement about said pulley means.

* * * * *